US005093947A

United States Patent [19]

Henegar et al.

[11] Patent Number: 5,093,947

[45] Date of Patent: Mar. 10, 1992

[54] CHILDREN'S NAP BLANKET

[76] Inventors: James R. Henegar; Carol A. Henegar, both of P.O. Box 554, Eaton, Ohio 45320

[21] Appl. No.: 683,909

[22] Filed: Apr. 11, 1991

[51] Int. Cl.[5] ..... A47G 9/00

[52] U.S. Cl. ..... 5/482; 5/413; 5/420; 5/419; D6/598; D6/600

[58] Field of Search ..... 2/69.5; 5/413, 417–420, 5/482, 494; D6/598, 600, 589

[56] References Cited

U.S. PATENT DOCUMENTS

| | | | |
|---|---|---|---|
| 1,263,825 | 4/1918 | Waugh | 5/413 |
| 1,548,312 | 8/1925 | Heibert et al. | 2/69.5 |
| 4,236,263 | 12/1980 | Allee | 5/413 |
| 4,316,287 | 2/1982 | Rule | 5/413 X |
| 4,579,753 | 4/1986 | Gjendemsjo | 5/413 X |
| 4,734,948 | 4/1988 | Danova | 5/502 |
| 4,802,251 | 2/1989 | O'Dell | 5/494 X |

*Primary Examiner*—Michael F. Trettel
*Attorney, Agent, or Firm*—Biebel & French

[57] ABSTRACT

A sleeping blanket is provided for use by a child taking a nap. The blanket is formed having an appearance configured as a member of the animal or plant kingdom and includes a body portion, covering portions and a head portion. The covering portions are cut from material so as to represent laterally extending appendages of the particular member of the animal or plant kingdom which is represented by the sleeping blanket. The body portion is of a sufficient size to receive a child lying thereon with his or her head resting on the pillow portion, and the covering portions are of sufficient size to be overlapped over each other for surrounding the child.

13 Claims, 10 Drawing Sheets

CHILDREN'S NAP BLANKET

BACKGROUND OF THE INVENTION

The present invention relates to sleeping blankets and more particularly to a sleeping blanket having an attractive appearance for encouraging children to take a nap.

Young children, particularly those of preschool age, typically are in need of a daily nap. However, it is often difficult to get the child to lie in a reclining or supine position long enough to fall asleep. If the child is placed on a bed during the nap time, the child will often putt the covers off the bed, sit up and talk, or throw things to the floor rather than laying down and falling to sleep.

It has been found that if the child is caused to lie down for only a few minutes when tired, the child will quickly drop off to sleep. However, it is difficult to get the child to lie still, particularly when he or she is overly tired, for a long enough period of time to fall asleep.

Providing the child with stuffed animals is among one of many inducements used in an attempt to get the child to lie still. Although this often works, many times the stuffed animals are among the objects thrown to the floor when the child refuse to fall asleep and becomes restless.

Accordingly, there is a need for a sleeping aid for children which will encourage them to lie quietly until they fall asleep for a nap. Further, there is a need for a child's sleeping aid which will be attractive to and produce a calming effect on the child taking a nap.

SUMMARY OF THE INVENTION

The present invention provides a sleeping blanket for use by a child taking a nap. The blanket is formed having an appearance configured as a member of the animal or plant kingdom and includes a body portion having opposed side edges and a longitudinal and lateral dimension to form a support area for supporting at least the torso area of a child lying in a supine position.

The sleeping blanket is further provided with first and second covering portions connected to respective ones of the opposed side edges. The first and second covering portions are symmetrically located with respect to a longitudinal axis of the body portion and each include an outer periphery which define laterally extending appendages of the member of the animal or plant kingdom. The appendages preferably have a longitudinal dimension at least as long as the longitudinal dimension of the body portion and a lateral dimension extending a distance within a range from at least half of the lateral dimension of the body portion to a dimension equal to or greater than the lateral dimension of the body portion. In addition, the covering portions are preferably connected to the body portion along substantially the entire length of the body portion such that the covering portions may be folded over the body portion to substantially overlie a child lying on the body portion.

The body portion is formed of two layers of material with batting material sandwiched therebetween to form a cushion. The cover portions are preferably each formed of two pieces of material attached to the body portion wherein the interior surfaces of the pieces of material forming the respective cover portions are in contact with each other such that the covering portions form relatively more flexible members as compared to the body portion.

A pillow portion is further provided attached to the body portion for receiving the head of a child lying on the body portion. The pillow portion has an appearance configured as an appendage which is normally attached to a longitudinal end of the body portion of the member of the plant or animal kingdom represented by the sleeping blanket. For example, if the sleeping blanket is configured as a member of the animal kingdom, such as a butterfly, the pillow portion would be formed as the head of the butterfly, the body portion would form the body of the butterfly and the covering portions would form the winds of the butterfly. Thus, a child could lie on the body portion with his or her head on the head of the butterfly, and the wings could be folded in overlapping relationship with each other over the child.

DETAILED DESCRIPTION OF THE PREFERRED EMBODIMENT

Figure 1:
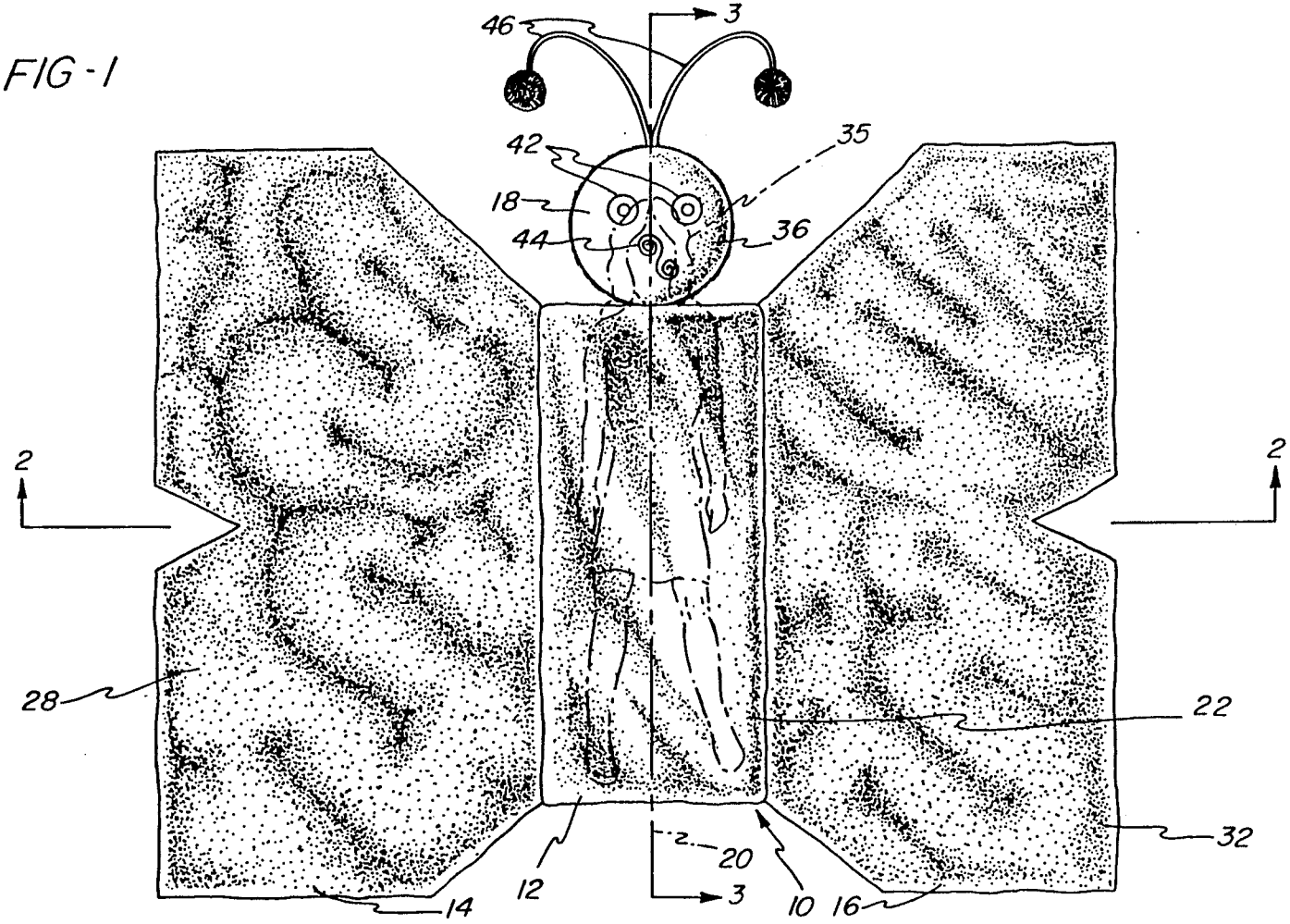
FIG. 1 shows a first embodiment of the sleeping blanket of the present invention configured in the shape of a butterfly.

Referring to FIG. 1, the preferred embodiment of the present invention will be described with particular reference to a butterfly shaped sleeping blanket. However, it should be understood that the following description is equally applicable to any member of the animal kingdom, either vertebrate or invertebrate, and to members of the plant kingdom.

The sleeping blanket, designated generally as 10, includes a body portion 12, a first covering portion 14, a second covering portion 16 and a pillow portion 18. The sleeping blanket 10 is formed substantially symmetrically about a central longitudinal axis 20 passing through the center of the body portion 12.

In this particular configuration of the invention, the body portion 12 defines the body of the butterfly, the covering portions 14 and 16 define the wings and the pillow portion 18 defines the head of the butterfly.

Figure 2:
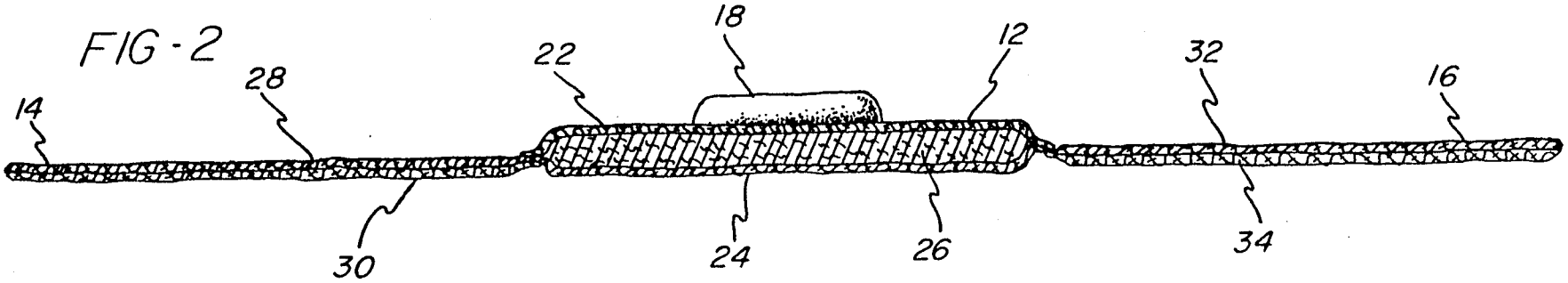
FIG. 2 is an elevational view taken along line 2—2 in FIG. 1.

Referring to FIG. 2, the body portion 12 is formed of first and second layers of material 22, 24. The batting 26 sandwiched between the two layers 22, 24. The body portion is seamed around the entire periphery thereof to enclose the batting material 26.

The covering portions 14, 16 are each formed of first and second layers of materials 28, 30 and 32, 34, respectively. The back or interior surfaces of the layers 28, 30 are in contact with each other as are the interior surfaces of the layers 32, 34, and the covering portions 14, 16 are each seamed around the periphery thereof. Thus, the covering portions 14, 16 do not contain any filler material and are therefore more flexible than the body portion to enable the covering portions 14, 16 to easily cover a child lying on the body portion 12.

Referring again to FIG. 1, it should be noted that the body portion 12 has a lateral dimension which in combination with the longitudinal dimension defines an area sufficient to receive at least the torso, and preferably to receive both the torso and leg area, of a child 35 lying in a supine position on the body portion 12. Further, the covering portions 14, 16 must have a sufficient transverse dimension, as measured in a direction perpendicular to the longitudinal axis 20, to allow the covering portions 14, 16 to be folded over and fully enclose a child lying on the body portion 12. Thus, each covering portion 14, 16 must have a lateral dimension at least half the width of the body portion and preferably is formed with a lateral dimension equal to or greater than the lateral dimension of the body portion 12. Also, since the pillow portion 18 receives the child's head, it will typically have a lateral dimension which is less than the lateral dimension of the body portion 12.

Figure 3:
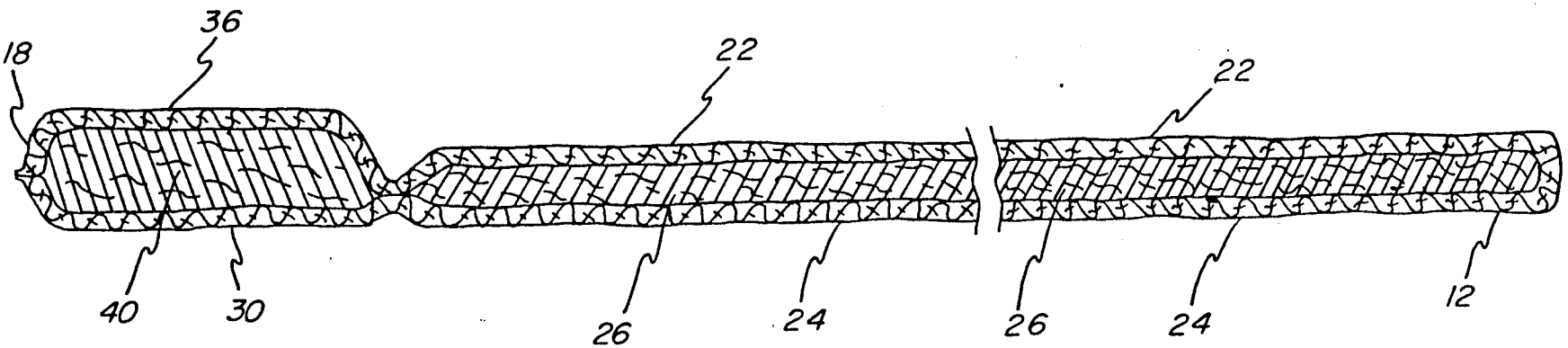
FIG. 3 is an elevational view taken along line 3—3 in FIG. 1.

Referring to FIG. 3, it may be seen that the pillow portion 18 is formed in a manner similar to that of the body portion 12 in that it is defined by two layers of material 36, 38 which enclose a layer of batting material 40. Further, it should be noted that the layer of batting material 40 within the pillow portion 18 is thicker than the layer of batting material 26 within the body portion 12 in order to provide a thickly cushioned pillow surface for receiving the head of a child lying on the sleeping blanket 10.

Any suitable material may be used for the sleeping blanket 10. However, in the preferred embodiment, an imitation fur material is used for all surfaces except the surface formed by layer 32 of covering portion 16. This particular layer is formed of a flannel material which acts as a good insulating material for insuring that the child stays warm and also provides a contrasting appearance when compared with the opposing covering portion 14.

It should also be noted that the pillow portion 18 may be provided with various decorative additions in order to enhance the appearance of the pillow portion forming a head. For example, eyes 42 and a tongue 44 may be added as well as antennas 46. These additions may be formed of any satisfactory material such as flannel or ribbon.

Figure 4:
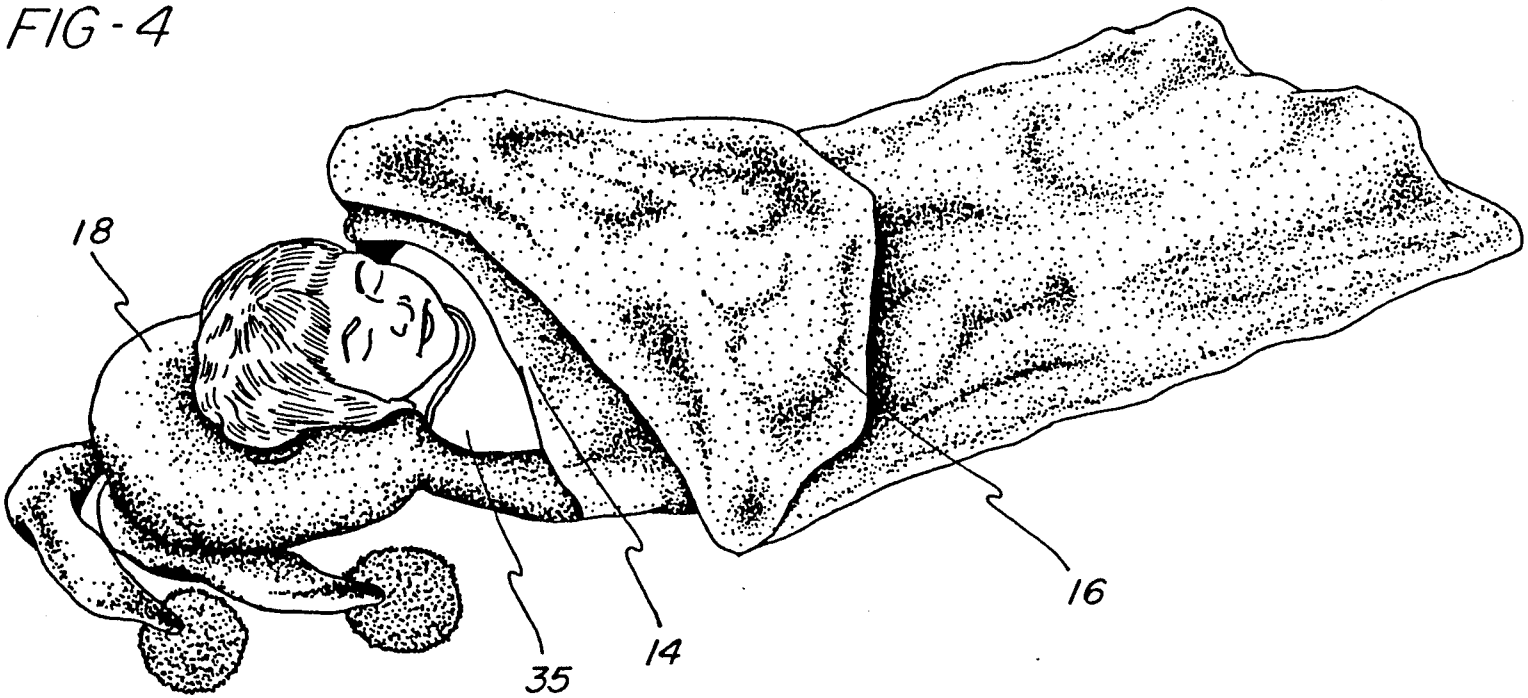
FIG. 4 is a perspective view of the embodiment of FIG. 1 with the covering portions folded over a child lying on the sleeping blanket.

In use, the sleeping blanket 10 may be placed on the floor with the covering portions 14, 16 extending laterally outwardly. A child may then lie on the body portion 12 which is formed of a sufficient length and width to form a cushion for both the torso and legs of the child. The child 35 lying on the body portion 12 may then lay his or her head on the pillow portion 18 and the covering portion 14 may then be folded over the child, folding the upper edge of the covering portion 14 downwardly in order to avoid covering the child's face. Subsequently, the other covering portion 26 may be folded over the child 35 while also folding the upper edge of the covering portion 16 downwardly as seen in FIG. 4.

With the child thus enclosed in the sleeping blanket, the child can imagine that he or she is being surrounded and cuddles by the butterfly within its wings. Also, when the child is in this position and imagines that the butterfly is holding him or her, the child will be less likely to want to squirm away from this secure position.

Figure 5:
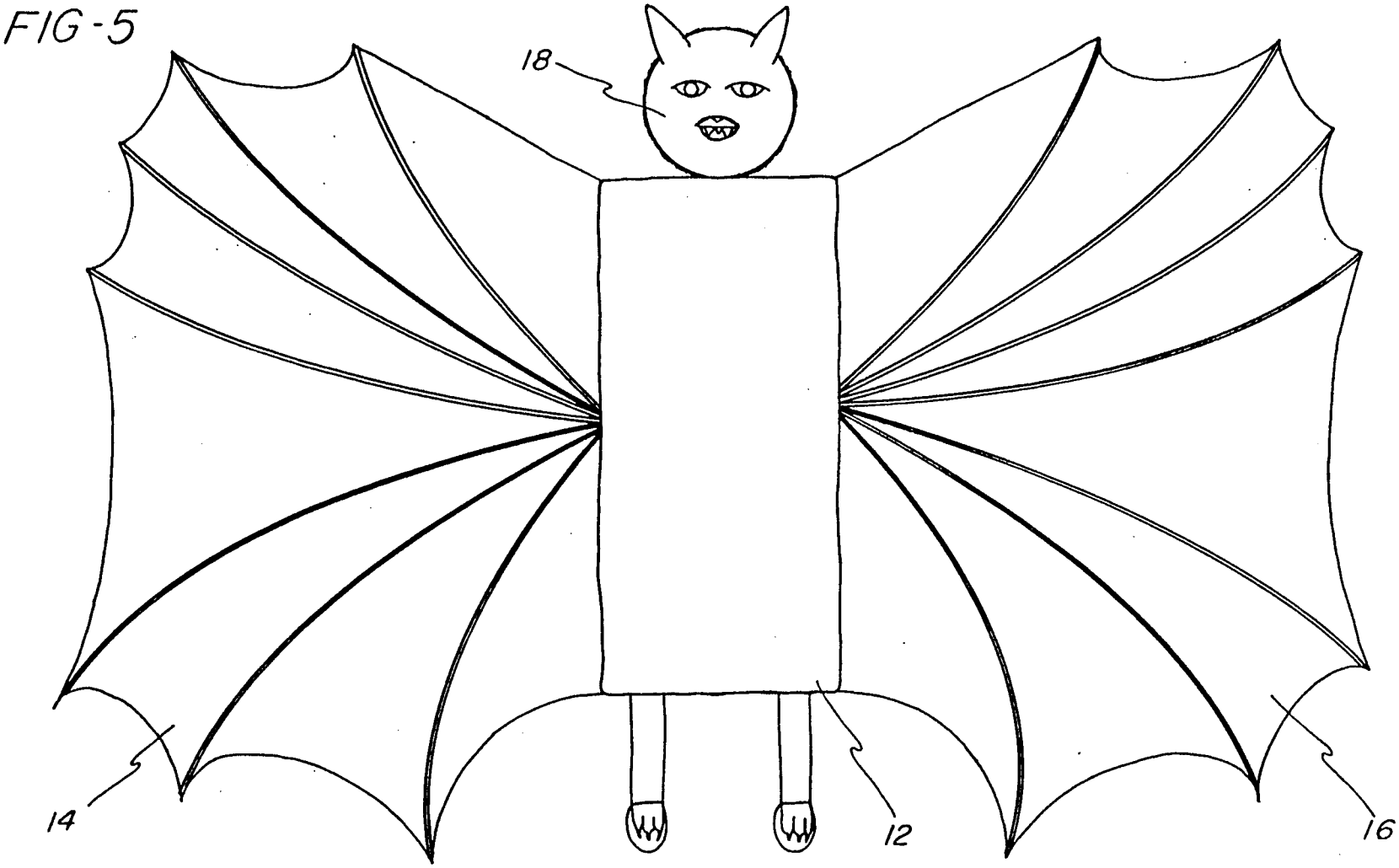
FIG. 5 shows the present invention configured as a bat.
Figure 6:
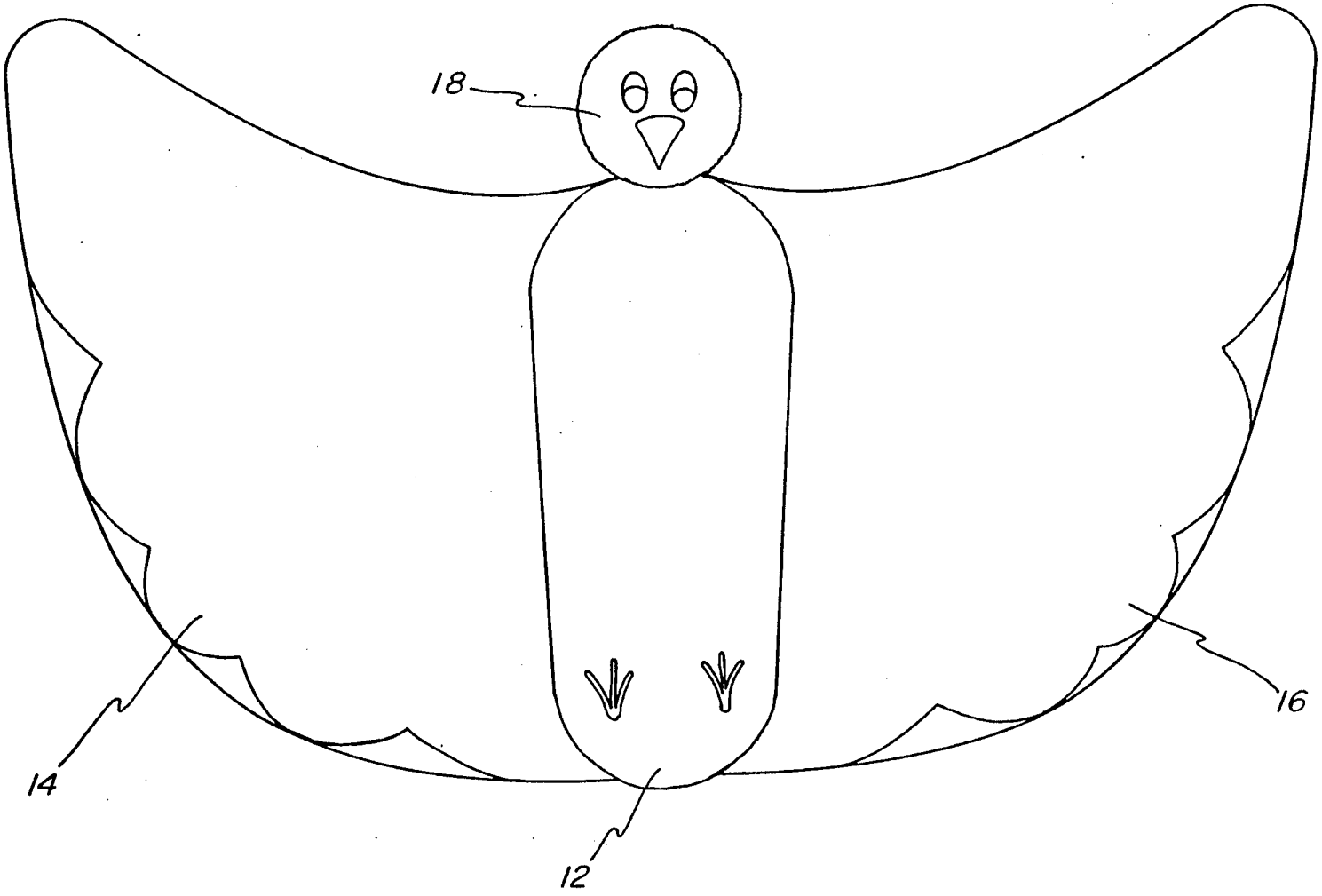
FIG. 6 shows the present invention configured as a bird.
Figure 7:
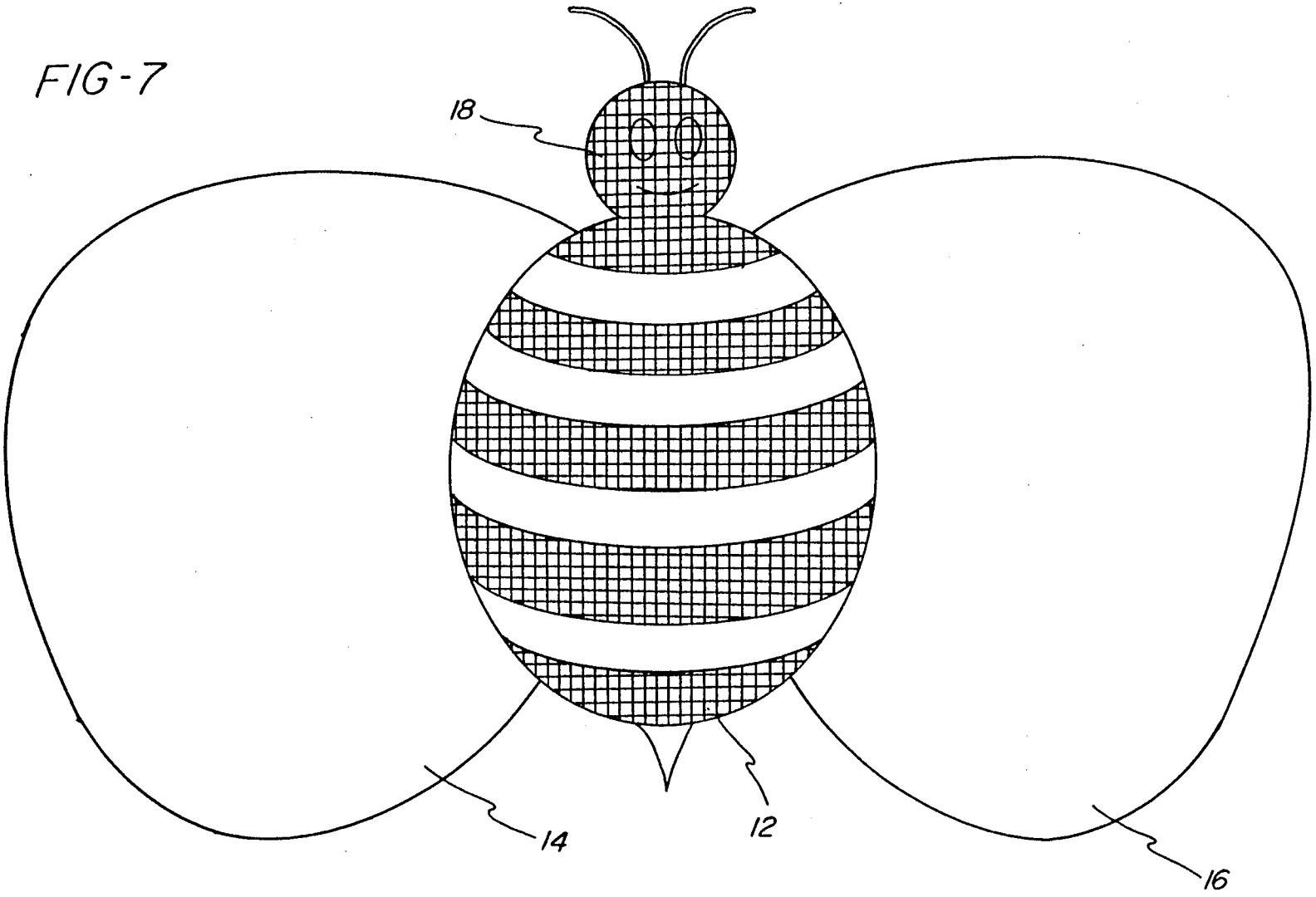
FIG. 7 shows the present invention configured as a bee.

FIGS. 5–11 disclose additional embodiments contemplated within the scope of the present invention in which elements corresponding to elements labeled in FIG. 1 are labeled with similar reference numerals. FIGS. 5–7 disclose additional flying animals including a bat in FIG. 5, a bird in FIG. 6, and a bee in FIG. 7.

As in the embodiment shown in FIG. 1, the covering portions 14 and 16 of FIGS. 5–7 are cut out to resemble the outline of the wings of the particular animal being represented and the body portion 12 is filled with batting to form a cushion for the child to lie on, while the head is stuffed with additional batting to form the pillow portion 18.

Figure 8:
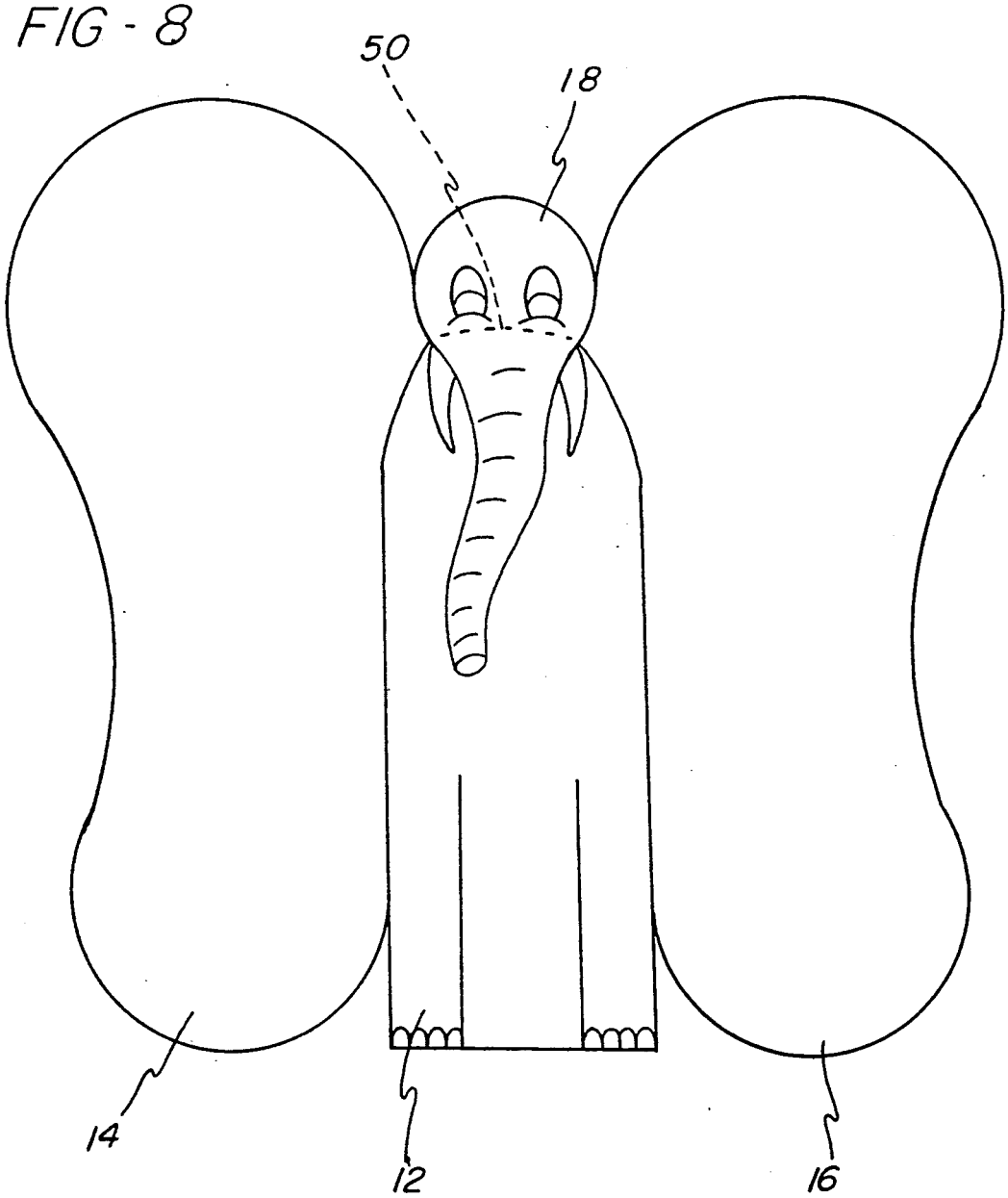
FIG. 8 shows the present invention configured as an elephant.
Figure 9:
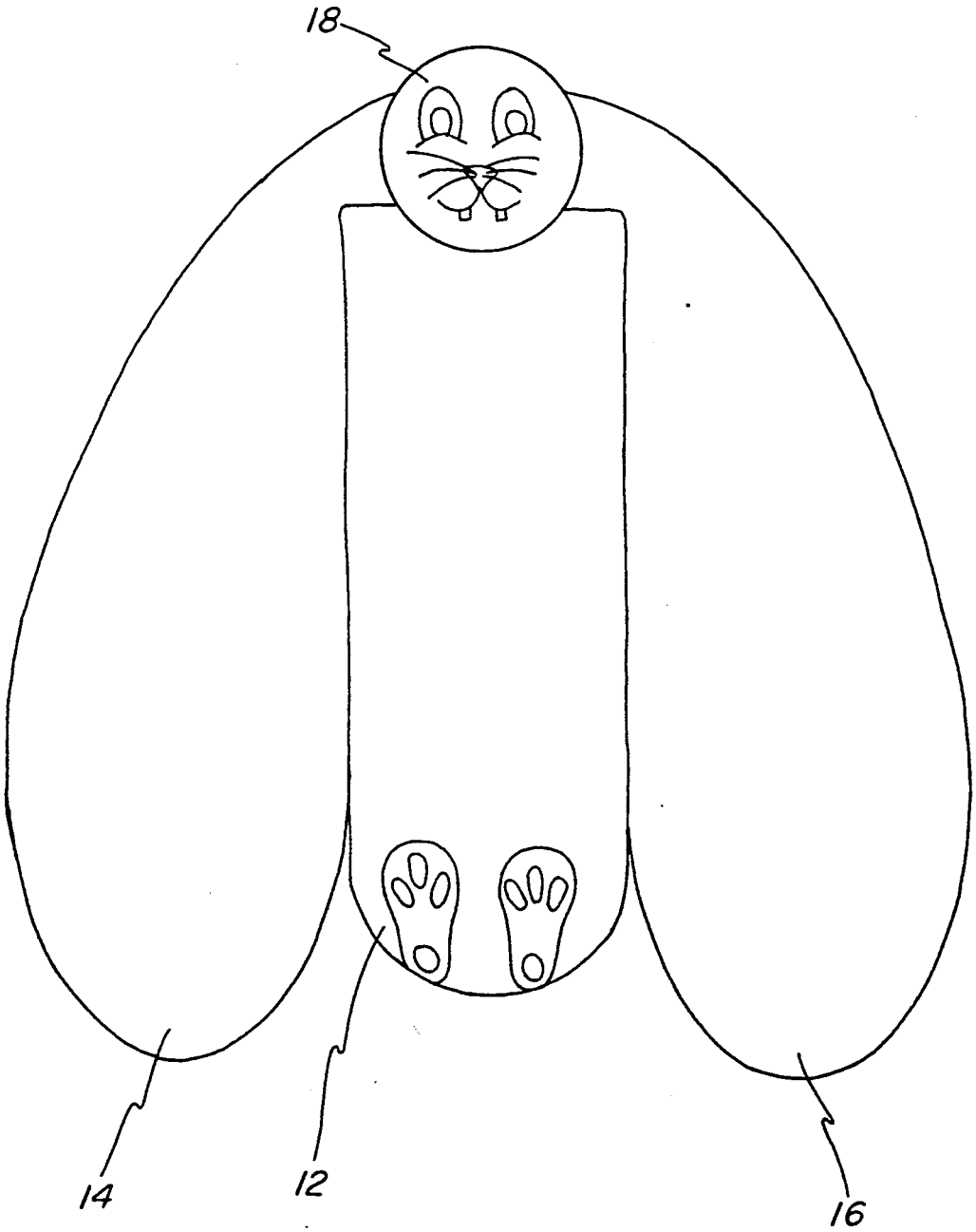
FIG. 9 shows the present invention configured as a rabbit.
Figure 10:
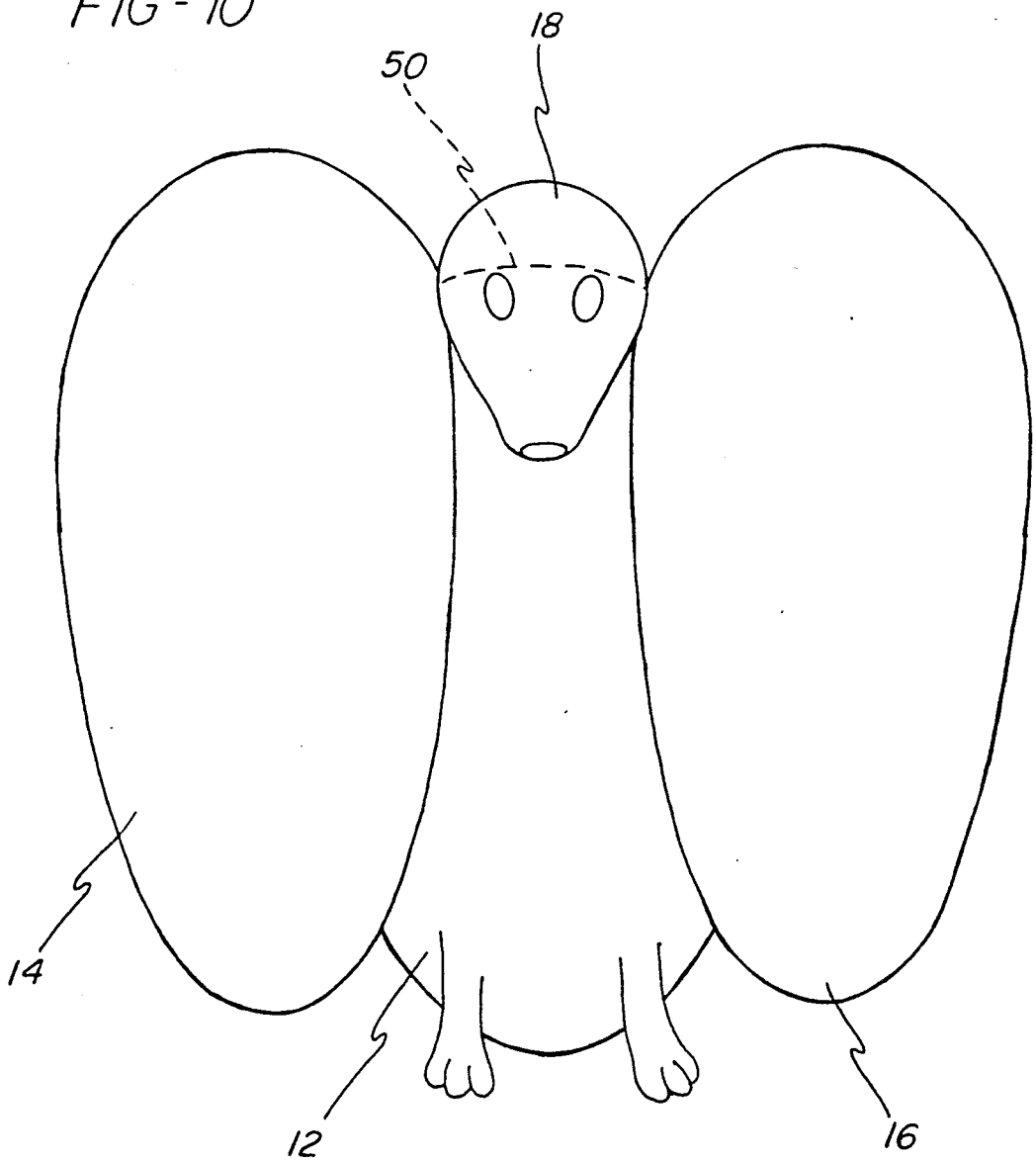
FIG. 10 shows the present invention configured as a dog.

In the embodiments shown in FIGS. 8–10, the blanket is cut out in the shape of a member of the animal kingdom having ears in which the ears define the covering portions 14 and 16. Thus, in FIG. 8, an elephant is shown, a rabbit is shown in FIG. 9 and a dog is shown in FIG. 10. In each of these embodiments the ears defining the covering portions 14, 16 have a longitudinal dimension extending substantially the entire length of the body of the animal. Also, it should be noted that where the animal has an elongated nose, the additional batting or padding for the pillow portion 18 may be provided at the upper half of the animal's head such as is defined by the area above the dotted line 50 in FIGS. 8 and 10.

Figure 11:
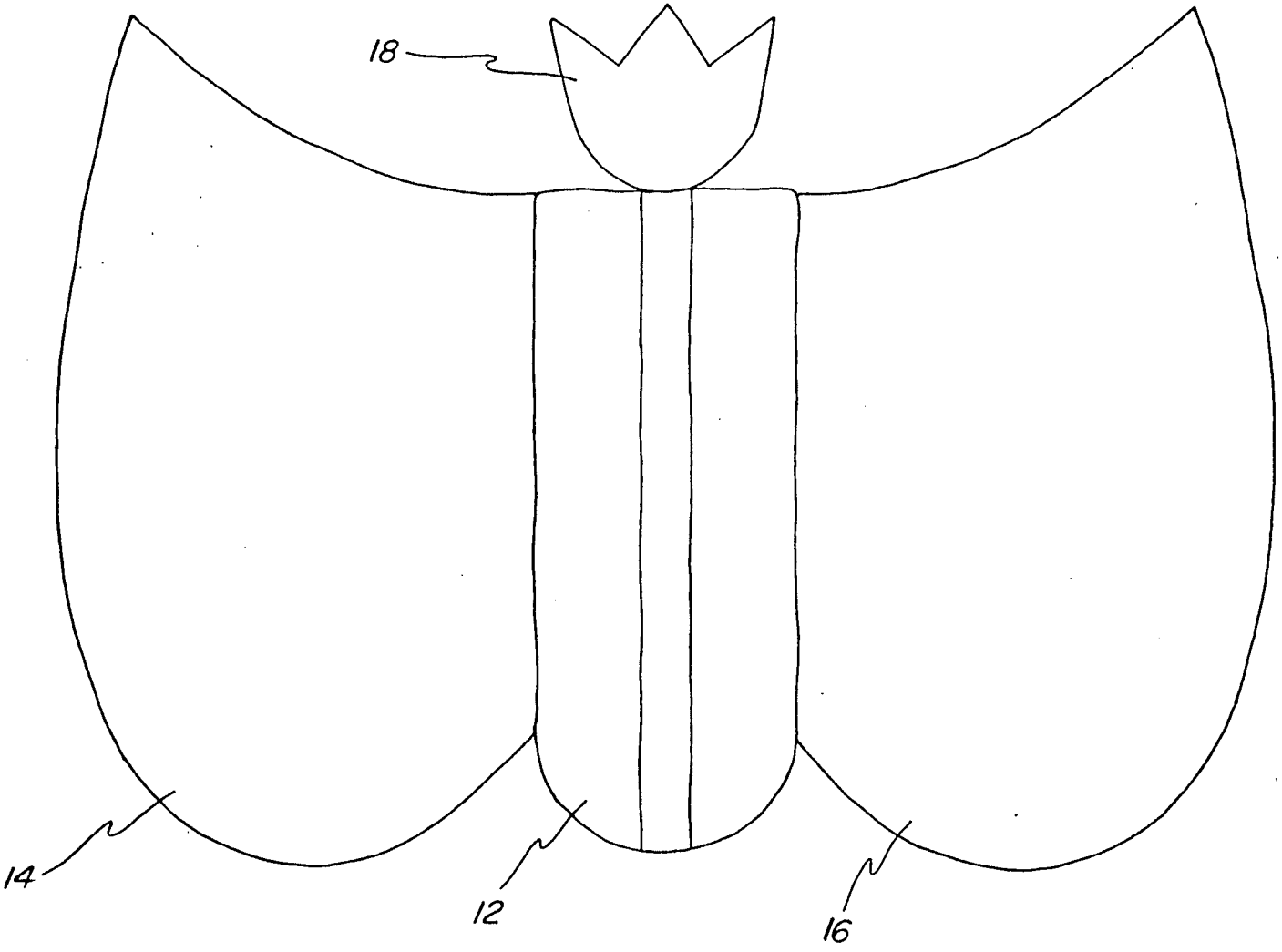
FIG. 11 shows the present invention configured as a flower.

Finally, where the material of the sleeping blanket is cut or configured so as to define a member of the plant kingdom, as depicted in FIG. 11, the covering portions 14, 16 may be shaped in the form of outwardly extending petals, the body portion 12 may be representative of the stem of the plant and the pillow portion 18 may be in the shape of a flower or other portion of the plant containing the reproductive organs or structure of the plant.

From the above description of the embodiments for the present invention, it should be apparent that the present invention provides a sleeping blanket which is configured or cut out in the shape of a member of the animal or plant kingdom. The central portion or body of the member of the plant or animal kingdom is represented by an elongated mat or cushion for a child to lie on, and laterally extending appendages of such represented member are cut out from material in an appropriate shape to define a covering portion whereby a child may be covered while lying on the central body portion.

By providing covering portions configured or cut out to represent the appendages of the desired member of the animal or plant kingdom, the child is given the impression of being enveloped within the appendages to give the child a secure feeling while taking a nap. Thus, the child is induced to remain lying down rather than engaging in movements which would prevent the child from falling asleep.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A sleeping blanket having an appearance configured as a member of the animal or plant kingdom, said blanket comprising:

a body portion having opposed side edges and having a longitudinal and lateral dimension to form a support area for supporting at least the torso area of a child lying in a supine position on said body portion, said body portion defining a central longitudinal axis of said sleeping blanket said body portion defining a body of said member of the animal or plant kingdom, first and second covering portions connected to respective ones of said opposed side edges, said first and second covering portions being symmetrically located with respect to said longitudinal axis and having peripheral edges, said first and second covering portions defining laterally extending appendages of said member of the animal or plant kingdom, a pillow portion attached to said body portion for receiving the head of a child lying on said body portion, said pillow portion having an appearance configured as at least a portion of an appendage which is normally attached to a longitudinal end of said body portion of said member of the animal or plant kingdom, and wherein said first and second covering portions have a lateral dimension in a direction perpendicular to said longitudinal axis which is greater than half of the said lateral dimension of said body portion whereby said covering portions may be folded laterally at the connection with said body portion to substantially overlie a child lying on said body portion.

2. The blanket of claim 1, wherein said lateral dimension of each of said covering portions is approximately equal to or greater than the lateral dimension of said body portion.

3. The blanket of claim 1, wherein said body portion and said covering portions each have a thickness dimension in a direct perpendicular to said longitudinal and lateral dimension of said body portion, and said thickness dimension of said body portion is greater than said thickness dimension of said covering portions.

4. The blanket of claim 1, wherein said body portion and said covering portions are each formed of first and second layers of material seamed around the periphery of each of said portions, a layer of batting separating said layers of material forming said body portion, and said first and second layers of each of said covering portions having interior surfaces in contact with each other whereby said body portion forms a cushion and said covering portions form relatively more flexible members, as compared to said body portion, for covering a child lying on said body portion.

5. The blanket of claim 1, wherein said sleeping blanket is configured having the appearance of a member of the animal kingdom and said pillow portion is configured as at least a portion of a head of said member of the animal kingdom.

6. The blanket of claim 1, wherein said sleeping blanket is configured having the appearance of a member of the plant kingdom and said pillow portion is configured as at least a portion of the plant which bears the reproductive organs of the plant such as a flower.

7. The blanket of claim 1, wherein said pillow portion and said body portion each have a thickness in a direction perpendicular to said longitudinal and lateral dimensions of said body portion, said thickness of said pillow portion being greater than said thickness of said head portion.

8. The blanket of claim 1, wherein said pillow portion has a lateral dimension which is less than the lateral dimension of said body portion.

9. The blanket of claim 1, wherein said sleeping blanket has an appearance configured as a member of the animal kingdom having wings and said body portion is configured in the shape of the body of said member of the animal kingdom and said cover portions are configured in the shape of said wings extending along substantially the entire longitudinal dimension of said body portion.

10. The blanket of claim 1, wherein said sleeping blanket has an appearance configured as a member of the animal kingdom having ears and said body portion is configured in the shape of the body of said member of the animal kingdom and said cover portions are configured in the shape of said ears, said ears extending along substantially the entire longitudinal dimension of said body portion.

11. The blanket of claim 1, wherein said first and second cover portions each have a longitudinal dimension, measured parallel to said longitudinal axis, which is substantially equal to or greater than said longitudinal dimension of said body portion.

12. The blanket of claim 11, wherein the connection between said covering portions and said side edges is defined by a seam extending along substantially the entire length of said body portion.

13. The blanket of claim 1, wherein said sleeping blanket has an appearance configured as a member of the plant kingdom having petals and said body portion is representative of the stem of said member of the plant kingdom and said cover portions are configured in the shape of said petals extending along substantially the entire longitudinal dimension of said body portion.

* * * * *